United States Patent [19]

Bielagus

[11] Patent Number: 4,653,648

[45] Date of Patent: Mar. 31, 1987

[54] DISK SCREEN OR LIKE SHAFT ASSEMBLIES AND METHOD OF MAKING THE SAME

[75] Inventor: Joseph B. Bielagus, Tualatin, Oreg.

[73] Assignee: Beloit Corporation, Beloit, Wis.

[21] Appl. No.: 724,098

[22] Filed: Apr. 17, 1985

[51] Int. Cl.[4] ..... B07B 1/16

[52] U.S. Cl. ..... 209/672; 209/931; 403/227

[58] Field of Search ..... 209/667, 671, 672; 403/220, 227

[56] References Cited

U.S. PATENT DOCUMENTS

| | | | |
|---|---|---|---|
| 1,119,454 | 12/1914 | Ritchie | 209/672 |
| 2,055,630 | 9/1936 | McLean | 209/672 X |
| 2,618,385 | 11/1952 | Silver et al. | 209/671 X |
| 3,010,522 | 11/1961 | Oppel | 209/671 X |
| 3,013,643 | 12/1961 | Perry | 403/227 X |
| 3,265,206 | 8/1966 | Allen | 209/672 |
| 3,861,815 | 1/1975 | Landaeus | 403/227 X |
| 3,979,963 | 9/1976 | Goettl | 403/227 X |
| 4,037,723 | 7/1977 | Wahl et al. | 209/672 |
| 4,239,119 | 12/1980 | Kroell | 209/672 |
| 4,301,930 | 11/1981 | Smith | 209/671 |

FOREIGN PATENT DOCUMENTS

| | | | |
|---|---|---|---|
| 0053386 | 12/1933 | Norway | 209/672 |

*Primary Examiner*—Robert B. Reeves
*Assistant Examiner*—Edward M. Wacyra
*Attorney, Agent, or Firm*—Dirk J. Veneman; Raymond W. Campbell; Gerald A. Mathews

[57] ABSTRACT

A disk screen or like shaft structure in which screen disks and spacers are connected together in modular relation. The spacers support the disks with inner edges of the disks spaced from inner surfaces of the spacers so that when the modules are supported on a shaft the inner edges of the disks will be maintained spaced from the shaft. The spacers are preferably made from nonmetallic material such as polyurethane. By placing the modules under predetermined endwise compression, the inner surfaces of the spacers are adapted to be extended inwardly from an initial edge relation generally aligned with the inner edges of the disks. Bolts may serve as the connectors for the disks and spacers for the modules, and facilitate assembling of the modules under endwise compression.

30 Claims, 7 Drawing Figures

DISK SCREEN OR LIKE SHAFT ASSEMBLIES AND METHOD OF MAKING THE SAME

Disk screens are desirable apparatus for screening or classifying discrete materials such as paper pulp, municipal wastes, and the like. Such screens comprise a screening bed having a series of corotating spaced parallel shafts each of which has a longitudinal series of concentric screen disks which interdigitate with the screen disks of the adjacent shafts. Spaces between the disks permit only material of acceptable size to pass downwardly through the rotating disks bed, and since the disks are all driven to rotate in a common direction from the infeed end of the screen bed to the outfeed or discharge end of the bed, the particles of material which are larger than the acceptable sizes of material will be advanced on the bed to the outfeed end of the bed and rejected.

Several prior expedients have been heretofore devised for mounting the disks on the shafts, but there has been a persistent need for improvements as will be apparent from the following discussion of certain prior arrangements.

For example, in U.S. Pat. No. 4,239,119 the disks are provided with central holes having spline projections that engage in perforated retaining plates arranged to be received about a shaft. The splines which extend through the perforations of the plates fit closely at their ends against the shaft and are wedged in the plates. In practice, though not so stated in the patent, it has been found necessary to weld the disks to the plates for stability.

In U.S. Pat. No. 4,037,723, the disks are in direct engagement at their inner edges with the square tubing shaft, and tubular spacers engage endwise with the disks.

In another arrangement, as disclosed in U.S. Pat. No. 4,301,930, the disks are welded to cylindrical module hubs and the modules are assembled end-to-end on shafts.

Difficulties with the described prior arrangements have been experienced. The modules are very difficult to remove after a short period of operation because of fretting and corrosion between the modules and the shaft. Fabrication and assembly are expensive and time consuming. Quality control is difficult, due to the number of operations and parts involved. In the welding and mechanical binding of the disks to the retainer plates or spacers or to the module hubs, there may be slight variations from true radial mounting so that there may be a certain amount of wobble or variations in interface spacings. It has been found that frequently the disks will loosen after several months of service.

In the copending application of Eduard Josef Thoma, Ser. No. 646,135, filed Aug. 31, 1984, now abandoned, tubular elastomeric spacers engage a square tubing shaft and the disks are supported on the spacers by means of shoulders on the disks, thereby maintaining inner edges of the disks spaced from the shaft. That arrangement does not lend itself to a modular organization of the disks.

It is to the overcoming of problems and deficiencies inherent in the prior constructions that the present invention is directed.

An important object of the present invention is to provide a disk screen apparatus in which the disks are assembled on the shafts in a new and improved manner which not only facilitates mounting of the disks onto shafts, but also facilitates disassembly when necessary.

Another object of the invention is to provide new and improved modular disk unit for disk screen shaft assemblies.

A further object of the invention is to provide a new and improved disk screen or like shaft assembly in which not only is there excellent control of disk wobble, but also an improved connection and support of the disks at their hubs.

Still another object of the invention is to provide a new and improved modular mounting for screen disks attaining positive shaft driving of the disks and preventing loosening of the disks, as well as attaining accurate modular length control and facilitating mounting or removal of the disks with respect to the shaft.

Yet another object of the invention is to provide a new and improved modular disk screen or like shaft assembly in which the disks are free from welding which permits use of any desired material for the disks, as well as attaining other advantages.

To the attainment of the foregoing and other objects of the invention, there is provided a disk screen or like rotatable shaft assembly, comprising an elongate metallic shaft member, a plurality of metallic screen disks mounted rotatably on the shaft member, and having central shaft-receiving openings complementary to the shaft member, but of slightly larger size so that edges defining the openings can be in spaced relation to the shaft member. Nonmetallic spacers are disposed between the disks and with surfaces of the spacers engaging the shaft member. There are means for connecting the disks and spacers together into a modular unit which can be slidably mounted on or removed from the shaft member, and the spacers support the disks on the spacers with the edges spaced from the shaft member, and the spacers separating the disks in predetermined spaced relation.

A plurality of the disk and spacer modules is adapted to be mounted end-to-end on each of the shafts in a disk screen.

A new and improved screen disk module and method of producing the same is provided.

Other objects, features and advantages of the invention will be readily apparent from the following description of a representative embodiment thereof, taken in conjunction with the accompanying drawings, although variations and modifications may be effected without departing from the spirit and scope of the novel concepts embodied in the disclosure, and in which.

Figure 1:
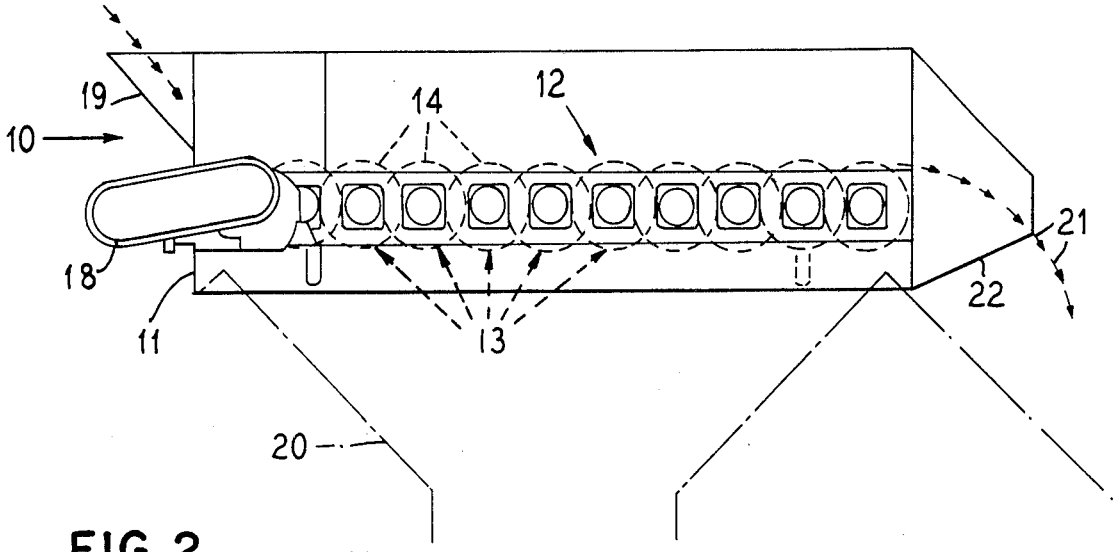
FIG. 1 is a side elevational schematic illustration of a disk screen apparatus emboding the invention.
Figure 2:
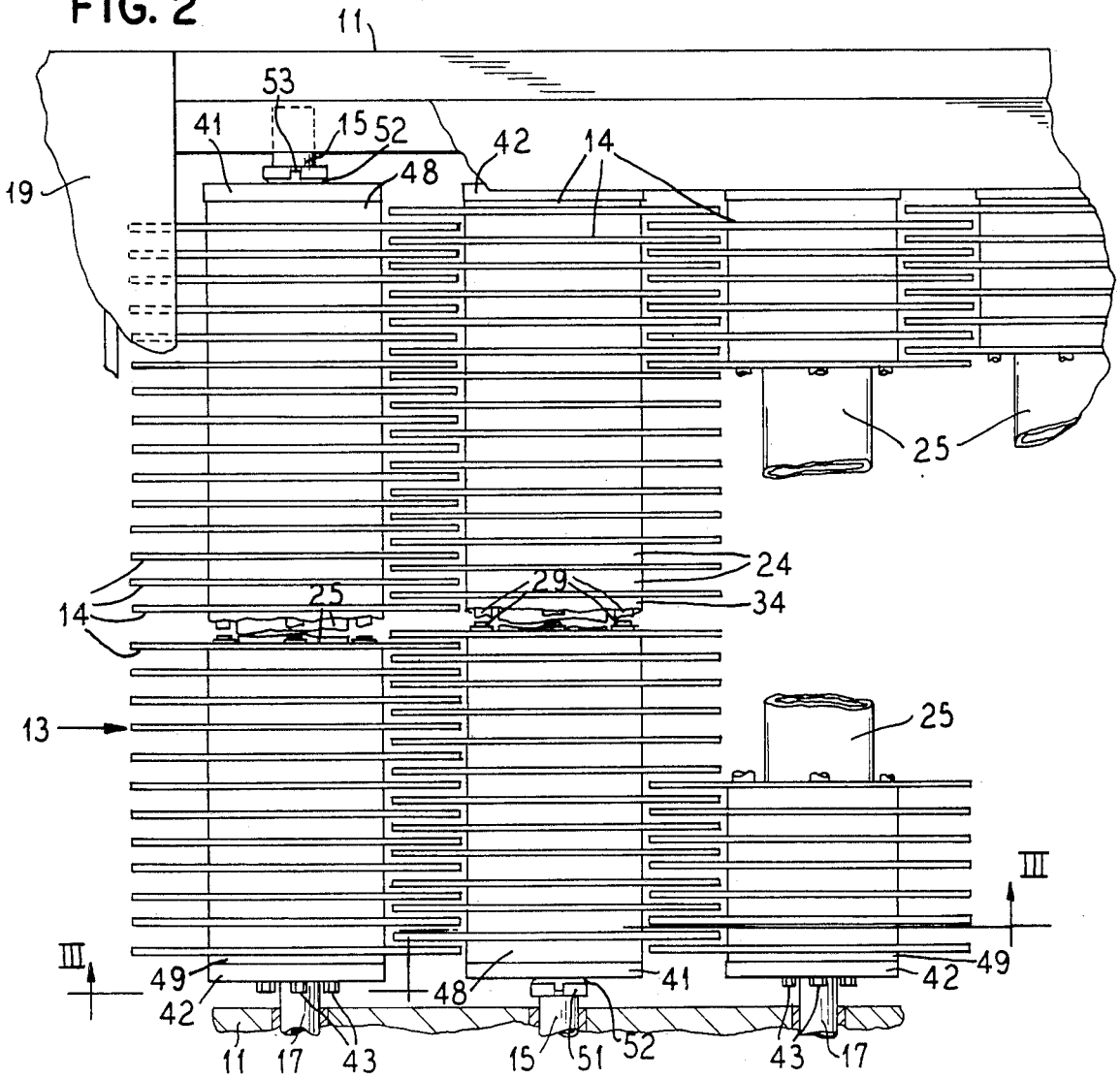
FIG. 2 is an enlarged fragmental top plan view of a portion of the screening bed of the apparatus.

As represented in FIG. 1, a disk screen apparatus 10 comprises a frame 11 supporting a screening bed 12, having a series of corotating spaced parallel shaft assemblies 13 of cylindrical perimeter and similar length, and each of which has a longitudinal series of concentric metal screen disks 14. As best seen in FIG. 2, the disks 14 of each of the shaft assemblies 13 interdigitate with the disks of the adjacent shafts. Each of the shafts 13 is preferably hollow tubular with a stub shaft 15 at one end and a stub shaft 17 at the opposite end, and the stub shafts are suitably journaled on the frame 11. Unison driving of the shafts 13 in the same direction, clockwise as seem in FIG. 1, is adapted to be effected by suitable drive means 18.

Figure 3:
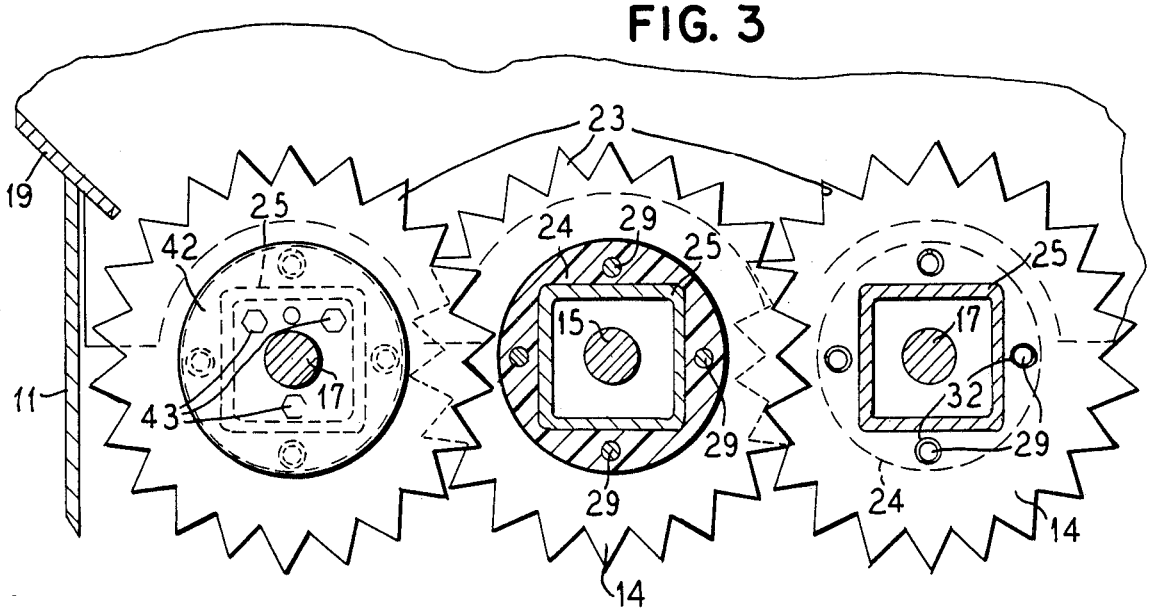
FIG. 3 is a fragmentary vertical sectional detail view taken substantially along the line III—III in FIG. 2.

Discrete material to be screened is delivered to the infeed end of the screening bed 8 by means of a chute 19. Acceptable size particles drop through screening slots defined by and between the interdigitated portions of the disks 14, and are received in a hopper 20. Particles which are too large to pass through the screening slots are advanced to and discharged, as indicated by directional arrows 21, from the rejects end of the screening bed, as by means of an outfeed chute means 22. The screening function of the disks 14, may be enhanced by a uniform generally sawtooth configuration of the outer perimeters of the disks 10 provided by teeth 23 (FIG. 3). The number of such teeth and their size may be dictated by the particular material to be processed. Although shown as relatively sharp, sawtooth shape, the teeth 23 may, depending upon use, be of different geometric forms, such as lobulate or the like.

Each of the disks 14 is spaced from each adjacent disk throughout the entire set of disks in each of the shaft assemblies 13, to provide the desired screening slot spaces between the annular interdigitated areas of the disks.

According to the present invention, the desired spacing between disks on each of the disk screen shaft assemblies 13, is attained and maintained by means of respective nonmetallic spacers 24 intervening between each adjacent pair of disks. In a practical arrangement, where the disks 14 are formed from metal of about 5/32 inch thickness and of a diameter from 15 inches to 19 inches, the spacers 24 may be about half the diameter of the disks. Each of the spacers 24 may be formed from a stiffly elastomeric synthetic plastic material, such as polyurethane of about 90 A durometer. Where a 6 mm spacing between the interdigitated disks is desired, and where the disk thickness is about 5/32 inch, the spacers 24 may comprise plates of about ⅝ inch thickness.

Figures 6, 7:
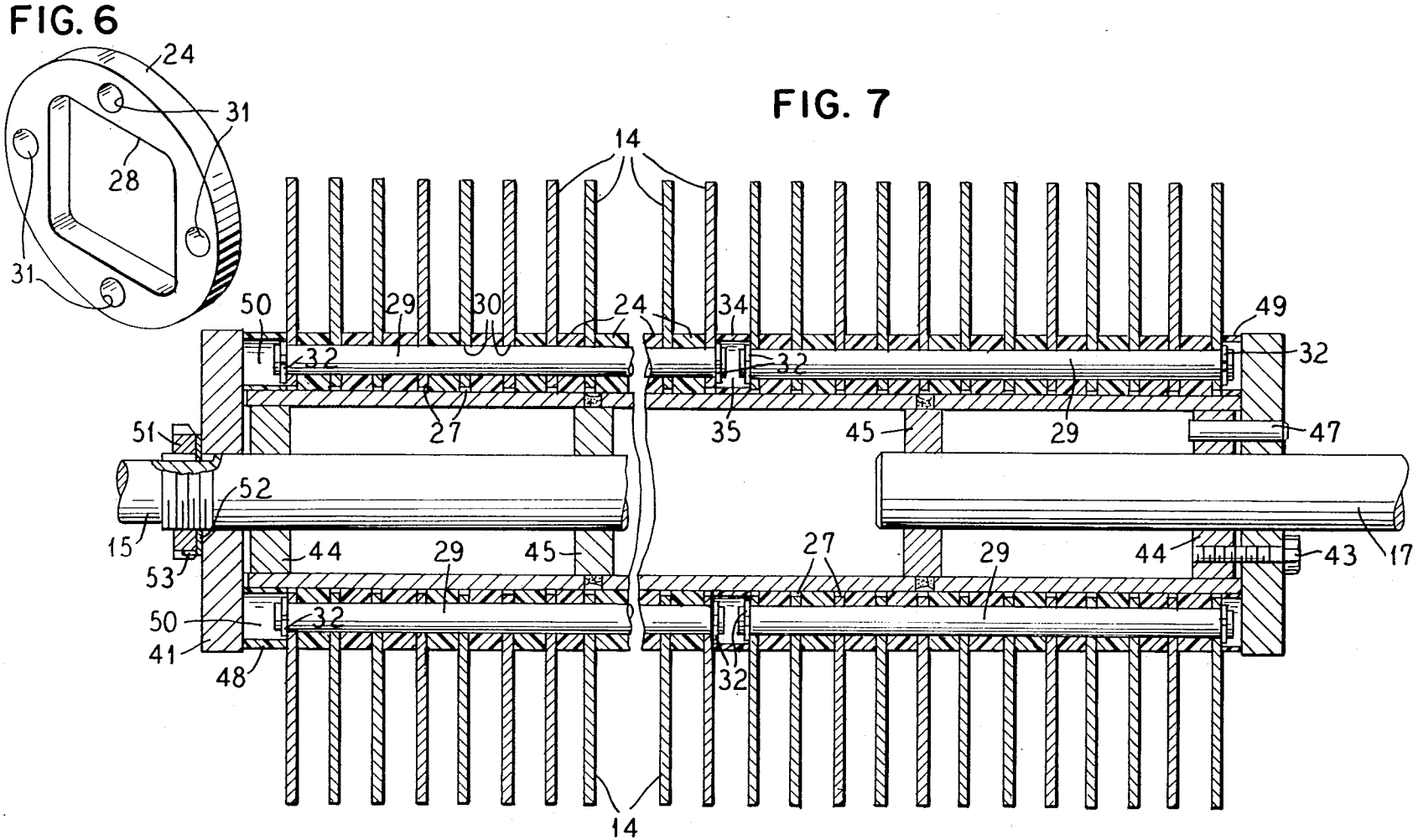
FIG. 6 is a perspective view of one of the disk spacers.
FIG. 7 is a fragmental longitudinal sectional detail view taken substantially along the line VII—VII in FIG. 3.

In a perferred construction, each of the disk screen shaft assemblies 13 comprises, as best seen in FIGS. 2, 3 and 7, a hollow tubular metal shaft 25 which is of a non-circular cross section, conveniently generally square, and of a length of about 10 feet to accommodate thereon up to 144 of the disks 14. Disk carrying shaft assemblies of this size are especially suitable for disk screens for screening materials such as wood pulp slurry in the paper making industry.

Each of the disks 14 has a central shaft receiving opening 27 complementary to the shaft cross section but of slightly larger size, as best seen in FIG. 7, so that the edges defining the openings can be in spaced relation to the shaft. Each of the circular spacers 24 has a central hole 28 therethrough which is complementary to the shaft cross section, and the hole is defined by edges dimensioned for engaging the shaft.

Means are provided for connecting the disks 14 and the spacers 24 so that the spacers support the disks with the inner edges, that is the edges defining the openings 27, spaced from the shaft. For convenience in assembling the disks 14 and spacers 24 on the shaft 25 in each instance, the disks and spacers are connected together in convenient size modules, such as twelve disks to each module. For this purpose, bolt means 29 are provided, such as four bolts extending through closely sized bolt holes 30 through the inner or hub margins of the disks 14 and matching bolt holes 31 in the spacers 24. Desirably the matching bolt holes 30 and 31 are located in equally spaced circumferential relation.

Each of the bolts 29 comprises a rod which may typically be about 0.750 inch in diameter and of a length which will extend sufficiently beyond each end of its module to accommodate, at each end, a snap ring retainer 32 received in an annular groove 33. Endwise projection of the bolts 29 at each end of the module is sufficiently less than the desired spacing between the disks of the modules, so that when the modules are placed end-to-end in assembly on the associated shaft 25 there will be no interference with proper spacing between the adjacent end disks 14 of the modules. Such spacing between the ends of contiguous modules in the series on the shaft is maintained by means of intermodule spacers 34 which are dimensioned generally similar to the spacers 24, but have clearance holes 35 therethrough large enough to accommodate the lockup snap ring carrying extermities of the bolts 29 of the contiguous disks module ends.

Figure 4:
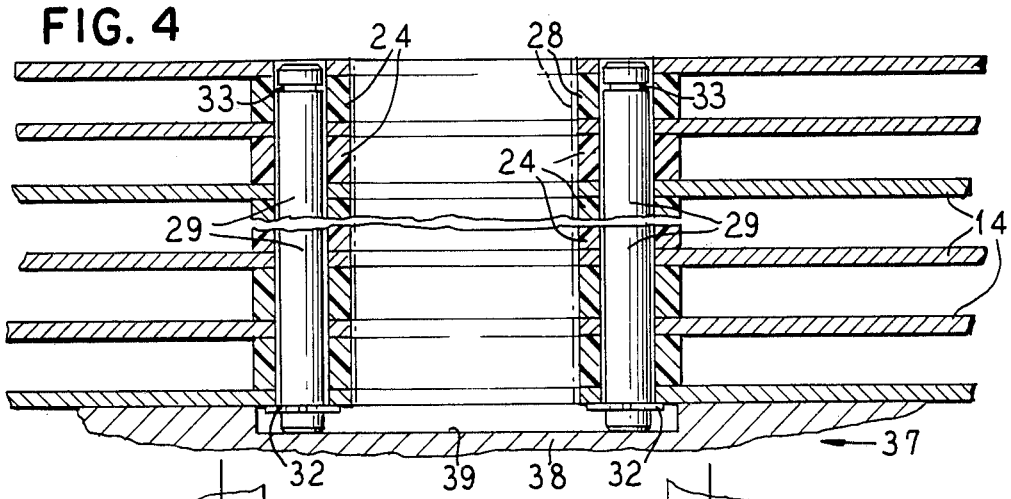
FIG. 4 is a fragmental, vertical sectional detail view demonstrating a step in the making of a disk module.
Figure 5:
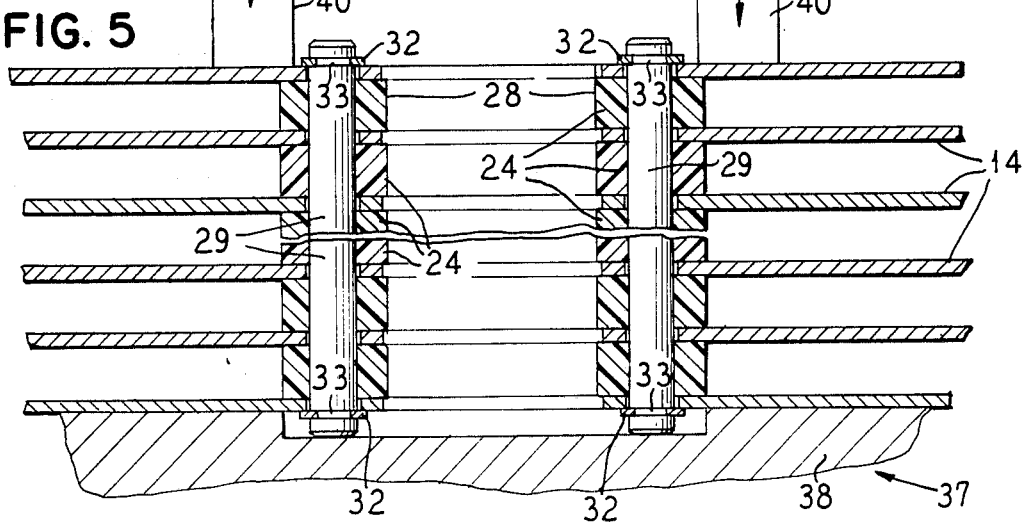
FIG. 5 is a similar view showing another, step in the making of the module.

As demonstrated in FIGS. 4 and 5, assembly of the disk modules is easily effected by assembling a set of the disks 14 and intervening spacers 24 on a set of the rods 29 (FIG. 4) in a jig 37, which has an anvil 38 on which an endmost disk 14 of a module stack is placed. The connecting bolt ends carrying the snap rings 32 and associated with the anvil 38 are accommodated in a clearance recess 37. At this stage in the assembling process, the full set of disks 14 and intervening spacers 24 may be slightly longer than in the final assembly, occasioned by having the spacers 24 initially slightly thicker than desired in the final assembly. When the module assembly is placed under end-wise compression, the inner edges of the spacers defining the holes 28 will flow or extrude inwardly from a dimension which may be initially the same as the fixed dimension of the edges defining the openings 27 to the desired reduced dimensions of the spacer hole edges for engagement with the shaft when the module is assembled with the shaft. This inward flow displacement is show in FIG. 4 by comparison of the full line initial dimension of the edges 28 with the phantom line dimension. Such compression is desirably to assure a tight, firm, wobble free assembly of the disks 14 with the spacers 24.

Compression of the module assembly may be effected between the anvil 37 and compressing plunger means 40 as shown in FIG. 5, and the retainer snap rings 32 on the remaining ends of the bolts 29 (the top ends in FIG. 5) secured in place to maintain the module in its operative condition. It will be appreciated that when it is desired to replace any of the disks 14, such as disks that may have been damaged in service, it is a simple matter to reverse the assembly steps, effect any replacements necessary and then reassembly and compress the assembly and secure it as already described, utilizing the jig 37 or its equivalent.

After the disk modules have been individually assembled as just described, they are assembled in end-to-end relation on the selected shaft 25 and locked in place thereon. In one desirable arrangement, the shaft 25 carries at one end thereof a rigid clamping ring plate 41 through which the stub shaft 15 projects, and at the opposite end a rigid clamping ring plate 42 through which the stub shaft 17 projects. Means are provided for drawing up the plates 41 and 42 toward the associated ends of the series array of disk modules, in this instances comprising headed screw bolts 43 at one end of the shaft assembly and which are threadedly engaged in a rigid centering disk 44 secured as by means of welding intermediate the ends of the respective stub shaft 17 and welded within the associate end of the hollow shaft 25. A similar stabilizing disk 45 secures the inner end portion of the stub shaft 17 within the hollow shaft 25. A centering pin 47 extends from the disk 44 through the associated clamping plate 42.

At the opposite end of the shaft assembly, similar rigid centering and connecting disks 44 and 45 secure the stub shaft 15 to the shaft member 25.

For applying yieldable compression to the associated ends of the disk module array, takeup means are provided comprising a take-up spacer ring 48 which is thrust by the plate 41 toward the adjacent endmost disk 14, and a takeup spacer ring 49 is thrust by the takeup plate 42 toward the endmost disk 14 at that end of the shaft assembly. Desirably both of the spacer rings 48 and 49 may be formed from the same material as the spacers 24. Each of the spacer rings 48 and 49 may have holes 50 therethrough, similar to the holes 35 in the spacers 34, for accommodating the associated ends of the connecting bolts 29.

In order to standardize on the construction of the screen disk shaft assemblies 13, the arrangement may be such that by alternately turning, i.e. reversing, the several shaft assemblies end-for-end proper interdigitation of the disks will be attained. A desirable expedient for attaining this result is to have the spacer ring 48 of about the same width as the spacers 24, while the spacer ring 49 is of half the width of the spacer ring 48. The ends of the hollow shaft member 25 extend a sufficient distant beyond the opposite ends of the array of disk modules to support the spacer rings 48 and 49.

At the clamping plate 42 end of the hollow shaft member 25, it serves as a stop for this plate as drawn up by the bolts 43.

By constructing the screen disk modules according to accurate standards, assembly of the modules on the shaft member 45 by sliding the same into place, and then locking the modules on the shaft can be quickly and easily effected. Such accuracy is implemented by the fact that the spacers 24, 34, 48 and 49 can be accurately cast in material such as polyurethane, incorporating therein fairly accurately calculated width dimensions and durometer or stiffness characteristics so that when each module assembly is completed, and then the array of modules is locked in place on the hollow shaft member, predetermined compression will attain predetermined measured relative spacing results for the screen disks 14 both with respect to one another and with respect to the hollow shaft member 25 and then with respect to the associated shaft assemblies in the screening bed 12. For example, when completing each of the disk modules, as demonstrated in connection with FIG. 5, 8500 pounds compressing pressure may be applied where the material is polyurethane of 90 A durameter. Such compression may be calculated to provide for about 0.020 inch inward deflection and extension of the inner edges of the spacers 24 substantially uniformly about each of the spacer holes 28, thereby supporting the inner edges of the disks 14 in a uniform 0.020 inch spaced relation to the shaft member 25.

Although the bolts 43 draw up the plate 42 against the end of the shaft 25, means are provided at the opposite end of the shaft assembly for drawing up the plate 41 against the spacer 48 with a limited range of compression latitude for attaining reasonably accurate overall measurement for the shaft disk array. Therefore, the spacer extends a limited distance endwise from the associated end of the shaft 25, and a locknut 51 threaded on the stub shaft 15 is torqued against the pressure plate 41 with sufficient pressure to attain the desired locked up compression of the disk modules between the end spacers 48 and 49. To retain the locknut 51 against unintended backing off, a lock washer 52 may be provided having locking tabs 53 bent into interlock grooves in the outer surface of the nut after torquing.

Among the advantages of having the spacers 24 and 34 and the compression members 48 and 49 made from a nonmetallic material and maintaining the metal disks 14 and the metal shaft 25 separated, in that fretting and corrosion "freezing" of the disk modules is avoided, so that replacement of disks is facilated, should that become necessary.

It will be evident from FIGS. 5 and 7 that the spacers 24 in cooperation with the connecting means bolts 29 retain the inner edges of the disks 14 effectively spaced from the central holes 28 of the spacers and from the surface of the shaft on which the disk modules may be mounted and with which the inner edges defining the holes 28 engage.

It will be understood that variations and modificatins may be effected without departing from the spirit and scope of the novel concepts of the present invention.

I claim as my invention:

1. A disk screen or like rotatable shaft assembly, comprising:

an elongate metallic shaft member;

a plurality of metallic disks mounted corotatively on said shaft member and having central shaft-receiving openings complementary to said shaft member but of sufficiently larger size so that edges defining said openings can be in substantially uniformly spaced relation to the shaft member;

nonmetallic spacers between said disks and with inner edge surfaces of the spacers extending inwardly beyond said edges defining said openings and engaging the shaft member;

and means for connecting said disks and spacers together into a modular unit which can be slidably mounted on or removed from the shaft member, and the spacers supporting said disks in cooperation with said connecting means on said spacers with said edges defining said openings substantially uniformly spaced from the shaft member.

2. An assembly according to claim 1, wherein said module is under predetermined endwise compression by said connecting means, and a plurality of like modules is mounted end-to-end on said shaft member.

3. An assembly according to claim 2, including a respective spacer between each of the adjacent ends of the modules and comprising nonmatellic material similarly as the between-disk spacers.

4. An assembly according to claim 2, including means for locking said modules on said shaft member under endwise compression.

5. An assembly according to claim 4, wherein said locking means include compression rings and compression plates at each end of the shaft assembly, said compression rings being of differential length so that the assembly can be mounted in alternate end-to-end relation with other like shaft assemblies of the same length and the disks of the assemblies will interdigitate.

6. An assembly according to claim 1, including means for placing said disks and spacers on said shaft member under endwise compression.

7. An assembly according to claim 1, wherein said spacers comprise polyurethane of 90 A durameter.

8. A module unit for a disk screen or like shaft assembly, the module being slidably mountable on or removable from a shaft member, and comprising:

a limited plurality of disks having central openings defined by edges, for receiving the shaft member therethrough, with said edges spaced from the shaft member;

spacers between said disks and having holes therethrough which are generally complementary to said shaft member so that surfaces defining said holes can engage the shaft member;

and means for connecting said disks and spacers firmly together in the module and with surfaces extending inwardly relative to the edges defining said disk openings so that said spacers in cooperation with said connecting means will support said disks with said edges of said disks spaced from the shaft member.

9. A module unit according to claim 8, wherein said means for connecting maintains the unit under predetermined endwise compression and length so that the unit can be mounted in end-to-end relation with other like module units on the shaft member.

10. A module unit according to claim 9, wherein said endwise compression is provided by bolts extending through said disks and spacers.

11. A module unit according to claim 10, wherein said spacers are formed as plates of plastic material, said surfaces defining said holes in said spacers being normally substantially equal in size to the edges defining said disk openings, and said endwise compression causing said spacers to be compressed and said spacer surfaces to extend inwardly relative to said disk edges.

12. A module unit according to claim 8, wherein said spacers comprise polyurethane of 90 A durameter.

13. A module unit according to claim 8, wherein said means for connecting said disks and spacers comprise a plurality of bolts extending through said spacers and the portions of said disks adjacent to said openings, the opposite ends of said bolts projecting beyond the endmost disks of the module, and snap ring means carried by said projecting bolt ends maintaining said module unit under endwise pressure.

14. A method of making a disk screen or like rotatable shaft assembly, comprising;

providing an elongate metallic shaft member;

mounting a plurality of metallic disks corotatively on said shaft member and the disks having central shaft receiving openings complementary to said shaft member but of sufficiently larger size so that edges defining said openings can be in spaced relation to the shaft member;

providing nonmetallic spacers between said disks with surfaces of the spacers extending inwardly beyond said edges and engaging the shaft member;

connecting said disks and spacers together by a connecting means into a modular unit which can be slidably mounted on or removed from the shaft member;

and supporting the disks by means of the spacers acting in cooperation with said connecting means so that said edges will remain spaced from the shaft member.

15. A method according to claim 14, which comprises placing said module under predetermined endwise compression, and mounting a plurality of like modules end-to-end on said shaft member.

16. A method according to claim 15, including placing respective nonmetallic spacers between each of the adjacent ends of the modules.

17. A method according to claim 15, including locking said modules on said shaft member under endwise compression.

18. A method according to claim 17, comprising applying said endwise compression through compression rings and compression plates at each end of the shaft assembly, and providing said compression rings of different lengths so that the assembly can be mounted in alternate end-to-end relation with other like shaft assemblies of the same length for interdigitation of the disks of the assemblies.

19. A method according to claim 14, which comprises placing said disks and spacers on said shaft member under endwise compression with a means in addition to said connecting means.

20. A method according to claim 14, which comprises forming said spacers from polyurethane of 90 A durameter.

21. A method of making for a disk screen or like shaft assembly, a module unit slidably mountable on or removable from a shaft member, comprising:

providing a limited plurality of disks having central openings, defined by edges, for receiving a shaft member therethrough of smaller cross section than said openings;

providing spacers between said disks and with holes through the spacers which are generally complementary to said shaft member cross sections so that surfaces defining said holes can engage the shaft member;

and connecting said disks and spacers firmly together by a connecting means into the module unit, with said surfaces extending inwardly beyond said edges, and said spacers supporting said disks by acting in cooperation with said connecting means so that said edges will remain spaced from said hole surfaces and positively spaced from the shaft member when the module is engaged on the shaft member.

22. A method according to claim 21, comprising forming said module of predetermined length and placing it under endwise compression so that the module can be mounted in end-to-end relation with other like modules on the shaft member.

23. A method according to claim 22, comprising effecting said endwise compression by extending bolts through said disks and spacers.

24. A method according to claim 22, comprising forming said spacers from synthetic plastic material and with said surfaces defining said holes in said spacers normally substantially equal in size to the edges defining said disk openings, and by said endwise compression causing said spacer surfaces to extend inwardly relative to said disk edges.

25. A method according to claim 21, comprising forming said spacers from polyurethane of 90 A durameter.

26. A method according to claim 21, comprising connecting said disks and spacers by extending a plurality of bolts through said spacers and the portions of said disks adjacent to said openings with the opposite ends of said bolts projecting beyond the endmost disks of the module, and applying snap ring means to said projecting bolt ends and thereby maintaining said module under endwise pressure.

27. A method of making a module according to claim 21, which comprises assembling said disks and spacers on bolts extending through said disks and spacers, applying endwise compression to the disks and spacers thus assembled on the bolts, and locking the compressed disks and spacers on the bolts.

28. A module unit for a disk screen or like shaft assembly, the module being slidably mountable on or removable from a shaft member, and comprising;

a limited plurality of disks having central openings defined by edges, for receiving the shaft member therethrough, with said edges spaced from the shaft member;

nonmetallic spacers between said disks and having central holes therethrough which are generally complementary to said shaft member so that surfaces defining said holes can engage the shaft member;

a plurality of smaller holes through said disks and spacers located in circumferentially spaced relation about said central holes;

bolts extending through said smaller holes and connecting said disks and spacers in the modular unit;

and said bolts acting with said spacers for supporting said disks with said edges spaced from the shaft member and said surfaces extending inwardly relative to said edges.

29. A module according to claim 28, wherein said spacers comprise bodies substantially thinner than the diameter of the spacers.

30. A module according to claim 28, wherein said spacers are formed from polyurethane of 90 A durameter.

* * * * *